US006041545A

United States Patent [19]

Sofy et al.

[11] Patent Number: 6,041,545

[45] **Date of Patent: *Mar. 28, 2000**

[54] DECORATIVE SURROUND FOR DISPLAY STAND

[75] Inventors: Janet M. Sofy, Troy; Brian D. Wood, Bloomfield Hills, both of Mich.

[73] Assignee: Hms Mfg. Co., Troy, Mich.

[ * ] Notice: This patent is subject to a terminal disclaimer.

[21] Appl. No.: 08/993,417

[22] Filed: Dec. 18, 1997

Related U.S. Application Data

[62] Division of application No. 08/831,022, Apr. 1, 1997.

[51] Int. Cl.[7] ..... A47G 7/02

[52] U.S. Cl. ..... 47/40.5

[58] Field of Search ..... 47/40.5, 39; 248/523; D11/130.1; 362/249

[56] References Cited

U.S. PATENT DOCUMENTS

| | | | |
|---|---|---|---|
| D. 70,397 | 6/1926 | Beazley | D11/130.1 |
| D. 71,246 | 10/1926 | Kelly | D11/130.1 |
| D. 79,274 | 8/1929 | Laroche | D11/130.1 |
| D. 161,404 | 1/1951 | Abel et al. | D11/130.1 |
| D. 165,530 | 12/1951 | Lasecki | D11/130.1 |
| D. 190,289 | 5/1961 | Engel | D11/130.1 |
| 329,208 | 9/1992 | Bowling et al. | 7/129 |
| 340,206 | 10/1993 | Bonney | 213/220 |
| D. 354,021 | 1/1995 | Kielbasa | D11/130.1 |
| D. 373,327 | 9/1996 | Rush et al. | D11/130.1 |
| D. 389,777 | 1/1998 | Altieri | D11/130.1 |
| 1,421,398 | 7/1922 | Burchess | 248/346 |
| 1,900,807 | 3/1933 | Fegley et al. | 248/44 |
| 2,190,544 | 2/1940 | Jarnagin | 248/523 |
| 2,297,191 | 9/1942 | Parman | 248/44 |
| 2,674,687 | 4/1954 | Priebe | 248/346 |
| 2,874,496 | 2/1959 | Rakes | 40/457 |
| 3,599,916 | 8/1971 | Szabo | 248/73 |
| 4,061,306 | 12/1977 | Taylor | 248/523 |
| 4,669,657 | 1/1987 | Crain et al. | 238/10 A |
| 4,714,219 | 12/1987 | Mayse | 248/65 |
| 4,769,749 | 9/1988 | Felski | 362/250 |
| 4,771,943 | 9/1988 | Cooney et al. | 238/10 E |
| 5,131,618 | 7/1992 | Cchapin | 248/523 |
| 5,279,871 | 1/1994 | Segan et al. | 428/18 |
| 5,481,444 | 1/1996 | Schultz | 362/249 |
| 5,497,972 | 3/1996 | Sofy | 248/523 |
| 5,513,081 | 4/1996 | Byers | 362/145 |
| 5,542,636 | 8/1996 | Mann et al. | 248/229.26 |
| 5,551,659 | 9/1996 | Sofy | 248/523 |
| 5,593,743 | 1/1997 | Baker | 428/18 |
| 5,607,230 | 3/1997 | Protz, Jr. | 362/396 |
| 5,709,462 | 1/1998 | Rumpel | 362/249 |

*Primary Examiner*—Michael J. Carone
*Assistant Examiner*—Fredrick T. French, III
*Attorney, Agent, or Firm*—Howard & Howard

[57] ABSTRACT

A rigid decorative shell (20) is provided for surrounding a display stand (22) which holds an upstanding element such as a Christmas tree (24) or display pole. The decorative shell (20) is formed of a first section (28) and a nestable second section (30). The first (28) and second (30) sections each render the general shape of a mountain village, and include a plurality of receiving areas (56) to which model structures (58) can be attached. A light bulb (70) is positioned within each model structure (58) to project light through windows and doorways. An annular shelf (50) provides an area for a model railroad track (52) and train (54). Male (82) and female (84) interlocking elements are located on the first (28) and second (30) sections for releasably connecting their left (36) and right (38) side edges together to restrain the first (28) and second (30) sections in an opposing operational relationship enshrouding the display stand (22). The male (82) and female (84) interlocking elements allow the decorative shell (20) to be conveniently installed over a fully erected display stand (22), and permit ready access to the erected display stand (22) in the event the Christmas tree (24) requires readjustment or other attention.

18 Claims, 7 Drawing Sheets

DECORATIVE SURROUND FOR DISPLAY STAND

RELATED APPLICATION

This application is a divisional of U.S. application Ser. No. 08/831,022, pending, filed Apr. 1, 1997.

BACKGROUND OF THE INVENTION

1. Field of the Invention

The subject invention relates generally to a decorative shell for a display stand which supports an upstanding element such as a Christmas tree or merchandise display pole.

2. Description of Related Art

Upstanding elements, such as Christmas trees or merchandise display poles, are usually supported in a small portable display stand. Such display stands are necessarily utilitarian constructions which frequently include some type of mechanical clamping feature to secure the stem of the tree or pole. In the case of Christmas trees, the stand may permit water containment to preserve freshness of a live Christmas tree. To hide the typically stark and less-than aesthetic appearance of the display stand, it is common to drape a fabric skirting around the base.

While such fabric skirtings have been favored over the years, the prior art has taught an alternative with many advantages. The alternative comprises a display stand having formed integrally thereabout a scaled or semi-scaled village scene, usually in a mountain setting. The rigid exterior of the stand, containing scenic model details, provides a particularly pleasing decorative effect. Examples of these alternative applications may be found in U.S. Pat. Nos. 2,190,544 to Jarnagin, issued Feb. 13, 1940; 2,874,496 to Rakes, issued Feb. 24, 1959; 4,061,306 to Taylor, issued Dec. 6, 1977; and Design patent application Ser. No. 29/035,331 to Heinrich, filed on or about Feb. 24, 1995.

However, these large structures are difficult to fabricate economically on a production basis and tend to be disfavored among retailers whose shelf space is limited. Furthermore, the integrated display stand and decorative exterior construction is difficult to store during off-seasons and periods of non-use because of its large size. Also related to its large size is the tendency of such integrated display stands to crack or otherwise fail prematurely.

SUMMARY OF THE INVENTION

A decorative assembly for surrounding a display stand for a tree and comprising a circular rigid shell having a concave interior and convex exterior and an upper neck portion defining an opening and a skirt portion depending from the upper neck portion to simulate a hill side.

The assembly is characterized by at least one receiving area for locating a model structure.

Accordingly, a plurality of differently configured model buildings may be attached to the shell to depict a mountain village, or the like.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
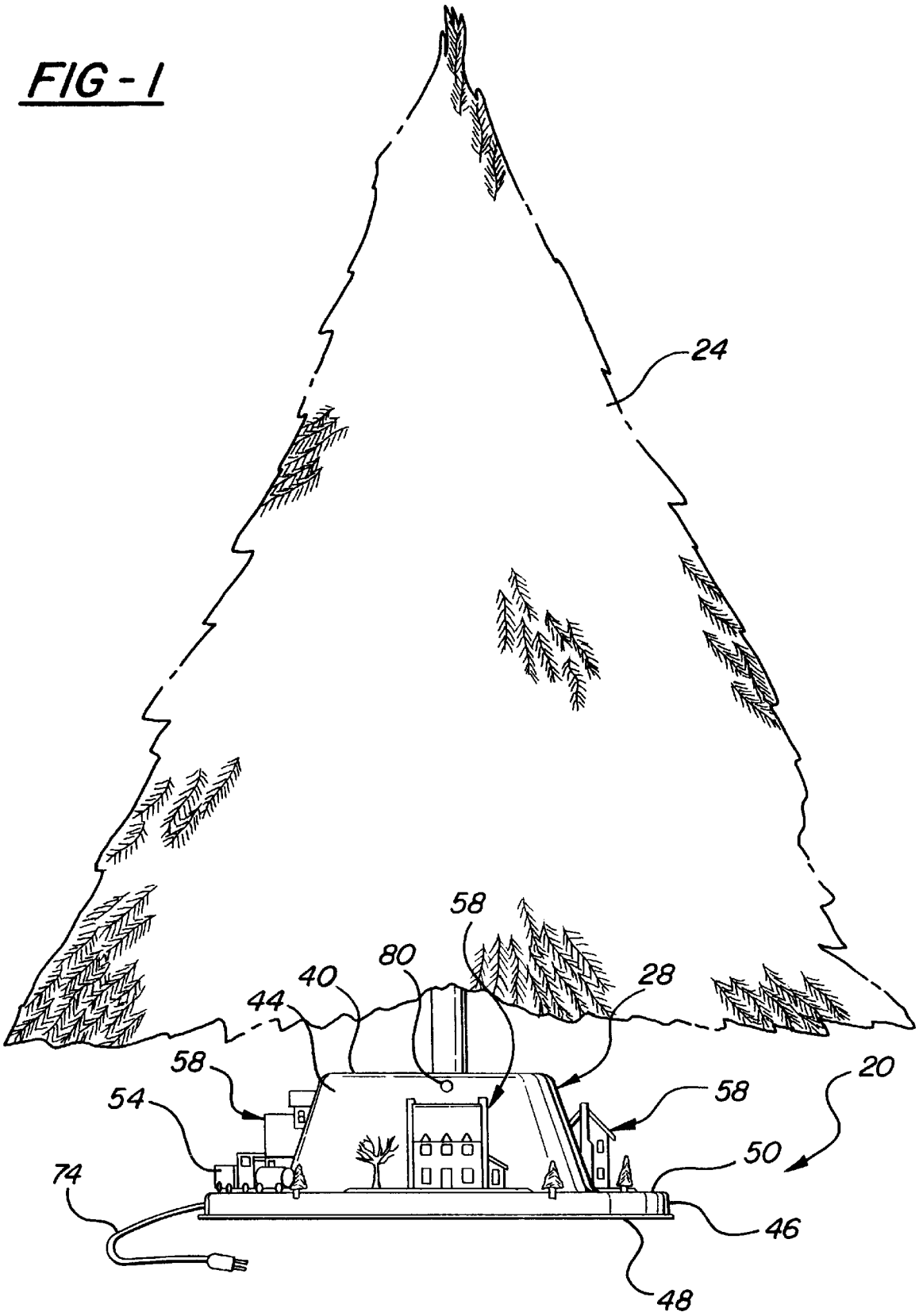
FIG. 1 is a front elevation view of a Christmas tree having a decorative shell surrounding a display stand, according to the subject invention.

Referring to the Figures, wherein like numerals indicate like or corresponding parts throughout the several views, a decorative shell is generally shown at 20. The decorative shell 20 is of the type for surrounding a display stand, generally indicated at 22. The display stand 22 supports an upstanding element such as a Christmas tree 24 in a generally vertical posture. In the preferred embodiment, the display stand 22 may be of any known construction which includes a receptacle for receiving a trunk of the Christmas tree 24, including display stands which rotate the Christmas tree 24. Those skilled in the art will appreciate that the display stand 22 may be used for other purposes, such as supporting a display pole for a point of sale rack or the like, without departing from the scope and spirit of the invention. Screws 26, collets, or some other form of restraining means holds the tree trunk securely in the receptacle.

The decorative shell 20 is preferably composed of two segments: a first section, generally indicated at 28, and a second section, generally indicated at 30. In the preferred embodiment illustrated in the figures, the first 28 and second 30 sections are identical to one another and can both be fabricated using the same plastic forming mold. Therefore, to facilitate understanding of the invention, the following detailed description of the first 28 and second 30 sections will be carried out with particular reference to the first section 28 only; it being understood that the second section 30 will include features identical to those described in connection with the first section 28. Furthermore, like reference numerals will be assigned to the various features of the second section 30. However, it will be appreciated that the first 28 and second 30 sections could be dissimilar. Those skilled in the art will readily understand that the shell 20 may be composed of more segments than the first 28 and second 30 sections. For example, and assuming the shell 20 has a generally round shape, three segments spanning each a 120° arc or four segments spanning each a 90° arc are also possible and within the scope of the invention.

Figure 2:
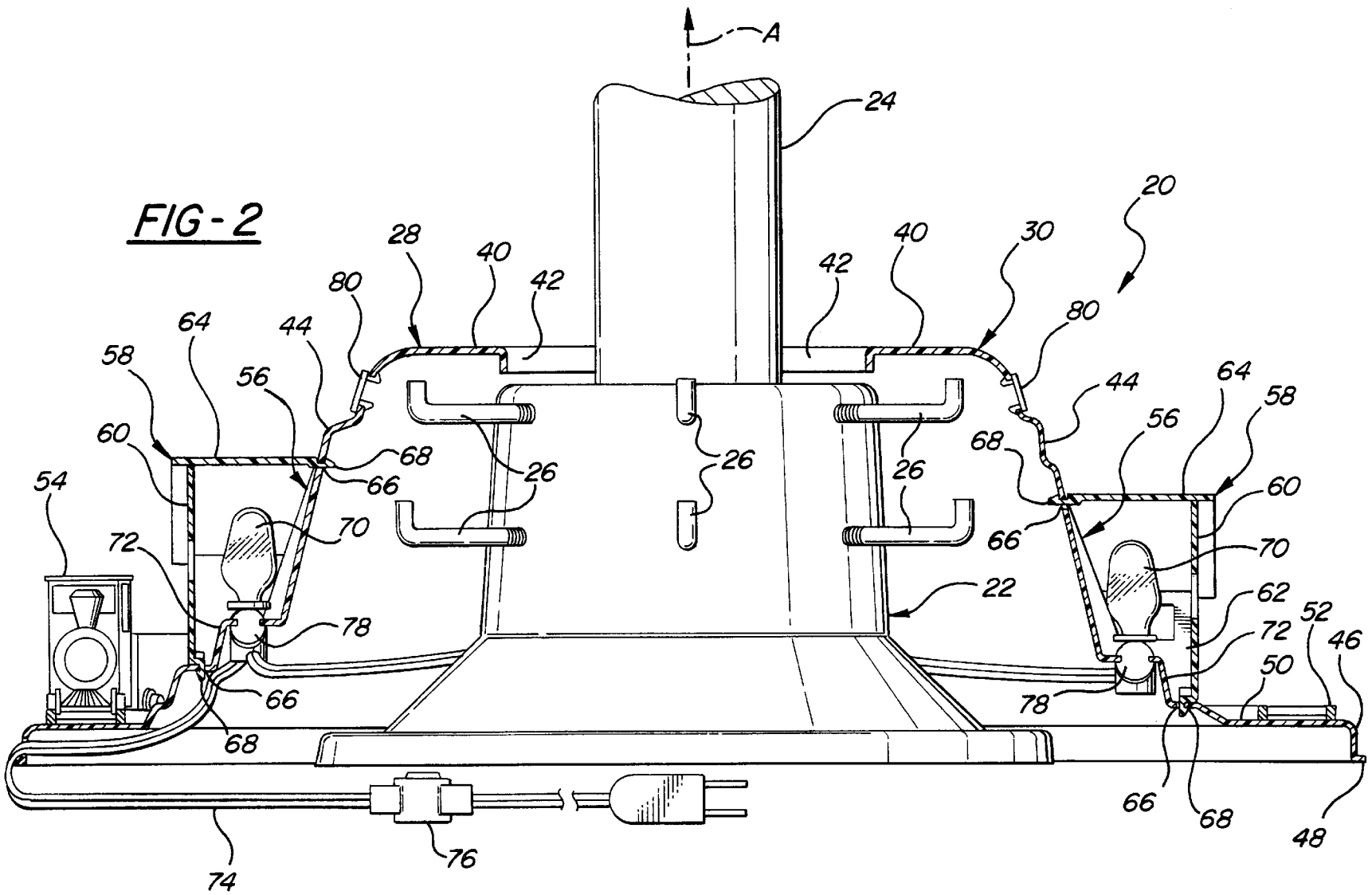
FIG. 2 is a cross-sectional view of the subject decorative shell surrounding a display stand.
Figure 3:
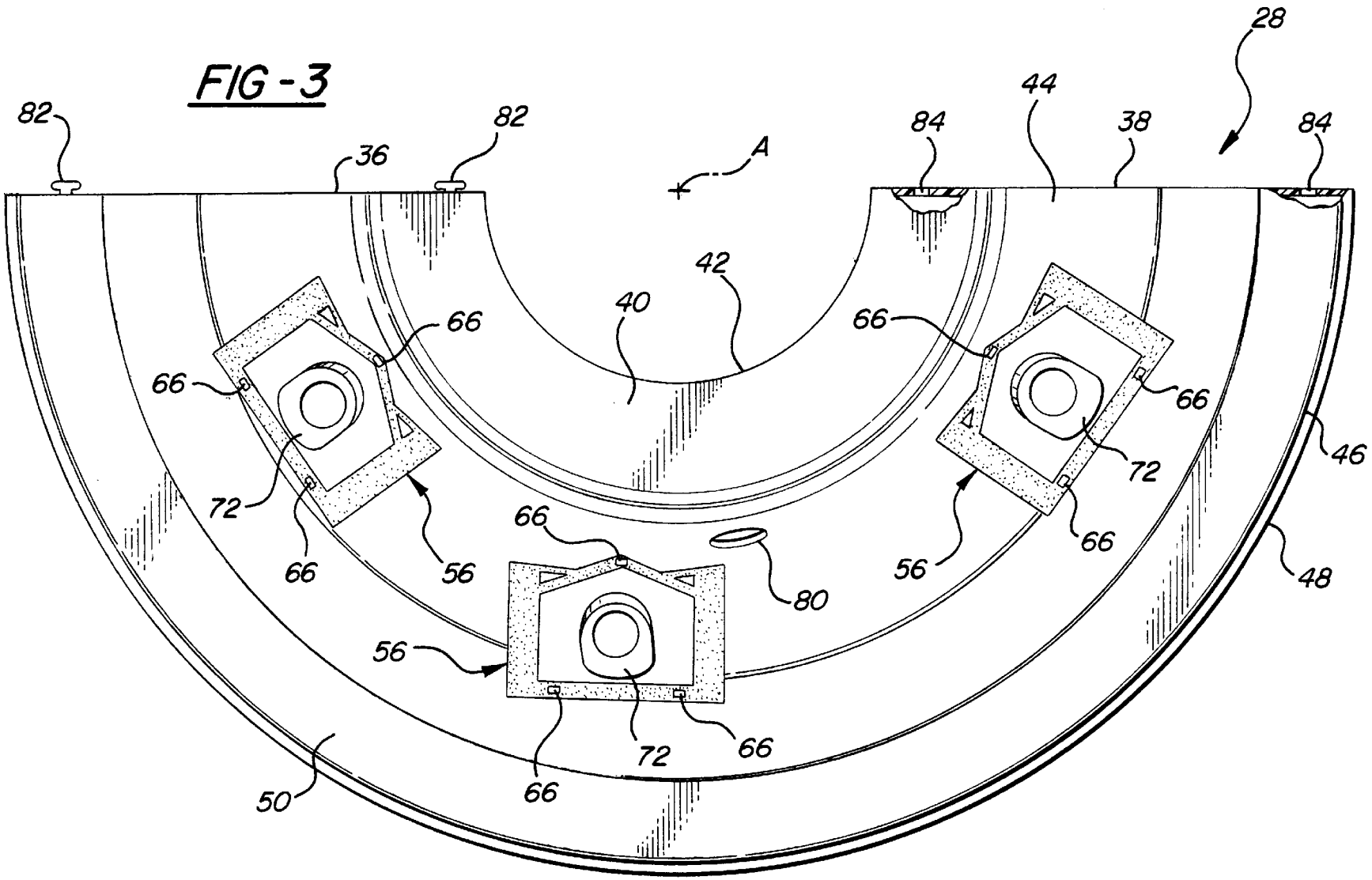
FIG. 3 is a top view of a right or left section of the subject decorative shell.
Figure 4:
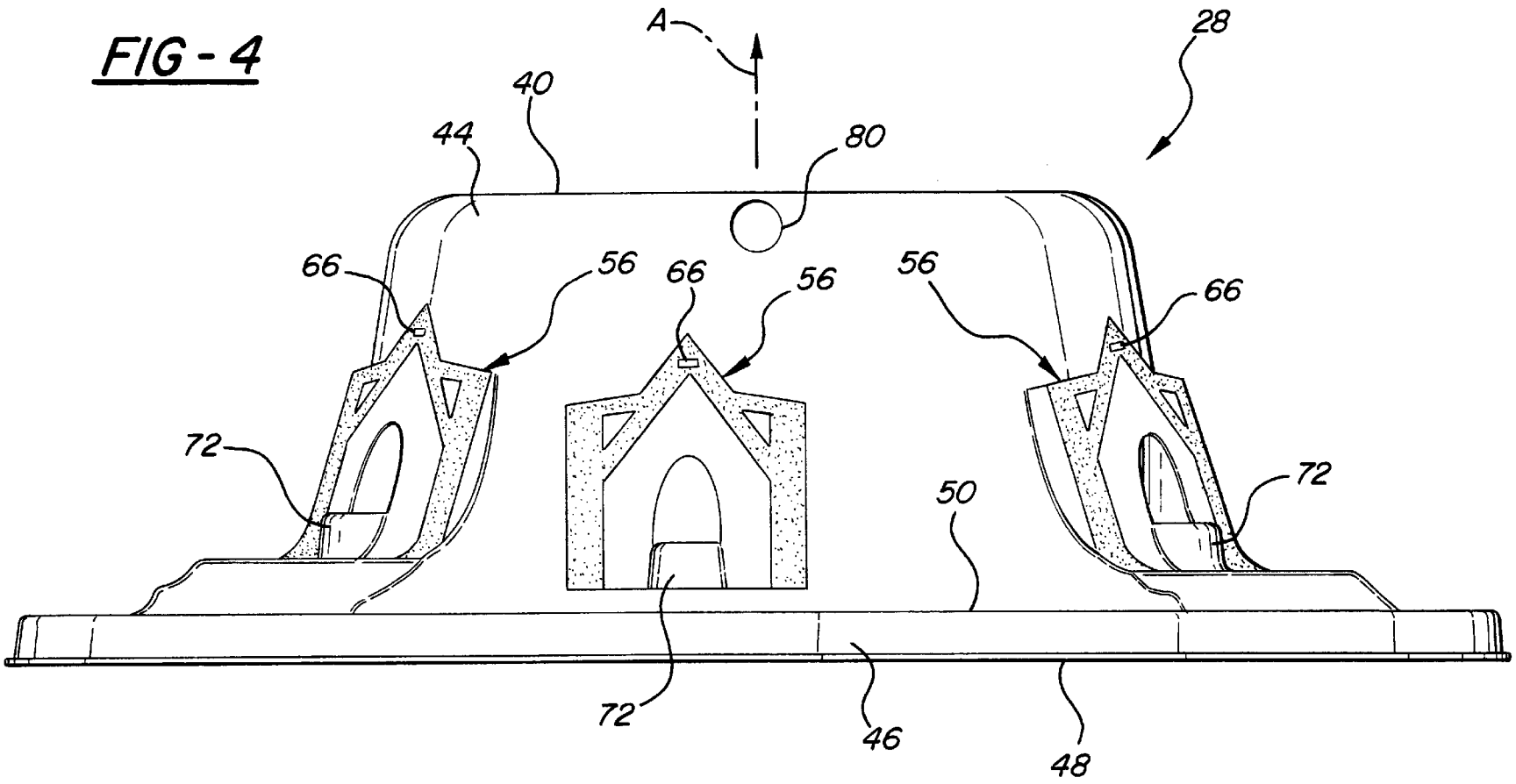
FIG. 4 is a front elevation of the subject decorative shell showing three receiving areas for model structures.

Referring to FIGS. 2–4, the first section 28 is shown as a thin walled plastic article having a concave interior and a convex exterior. The general design of the first section 28 lends itself to fabrication in a plastic injection or vacuum forming operation. The first section 28 is generally semi-circular about a central axis A, and includes diametrical left and right side edges 36, 38, respectively. The left 36 and right 38 side edges comprise vertically extending flanges adapted to abut the respective right 38 and left 36 side edges of the second section 30 in an opposing operational relationship. The semi-circular shape of the first section 28, together with the identical semi-circular shape of the second section 30, yield a generally round or conical shape when the two sections 28, 30 are in the opposing operational relationship. However, other geometric shape are possible, e.g., elliptical, oval, polygonal, etc., and fully within the scope of the invention.

The first section 28 includes an annular top surface 40 having a concave arcuate neck portion 42. The neck portion 42, together with the neck portion 42 of the second section 30, defines a clearance opening for the Christmas tree 24 when in the opposing operational relationship. A depending skirt portion 44 may be undulated or otherwise textured to simulate a scaled mountain side or hill side. When molded or painted in white, the skirt 44 appears as if snow-covered. An annular leg 46 extends downwardly from the skirt 44 to support the first section 28 above a floor surface. The leg 46 has a peripheral flange 48 which projects outwardly from the lower extremity thereof to increase the surface area contact with the floor.

A shelf 50 may be formed in the skirt 44, adjacent the leg 46. The shelf 50 of the first section 28 and the shelf 50 of the second section 30, together establish a continuous pathway when the two sections 28, 30 are in the opposing operational relationship. In the preferred embodiment illustrated in the Figures, the shelf 50 is contained in a horizontal plane. However, it will be appreciated that the shelf 50 may have contour to simulate elevation changes. The shelf 50 is particularly adapted for receiving a model railroad track 52, as shown in FIGS. 1 and 2. A model train 54, of either the electric or non-powered type, rides along the track 52. The shelf 50 has a radial width between 1–3 inches and a radius of curvature relative to the central axis A between 14–18 inches (measured at its centerline).

The first section 28 further includes at least one, and preferably three, receiving areas, generally indicated at 56, for each locating a model structure, generally indicated at 58. The receiving areas 56 are all identical to one another so that the model structures 58 can be freely relocated among the several receiving areas 56 as desired. The receiving areas 56 are generally flat, or planar, surfaces which protrude slightly from the skirt 44, so that the model structures 58 mate thereagainst without an appreciable gap. Although, other surface configurations for the receiving area 56 and model structure 58 interface would be acceptable, so long as no appreciable gap is exposed therebetween. The three receiving areas 56 can either be symmetrically arranged or asymmetrically arranged with different circumferential and elevational spacings about the first section 28.

Figure 5:
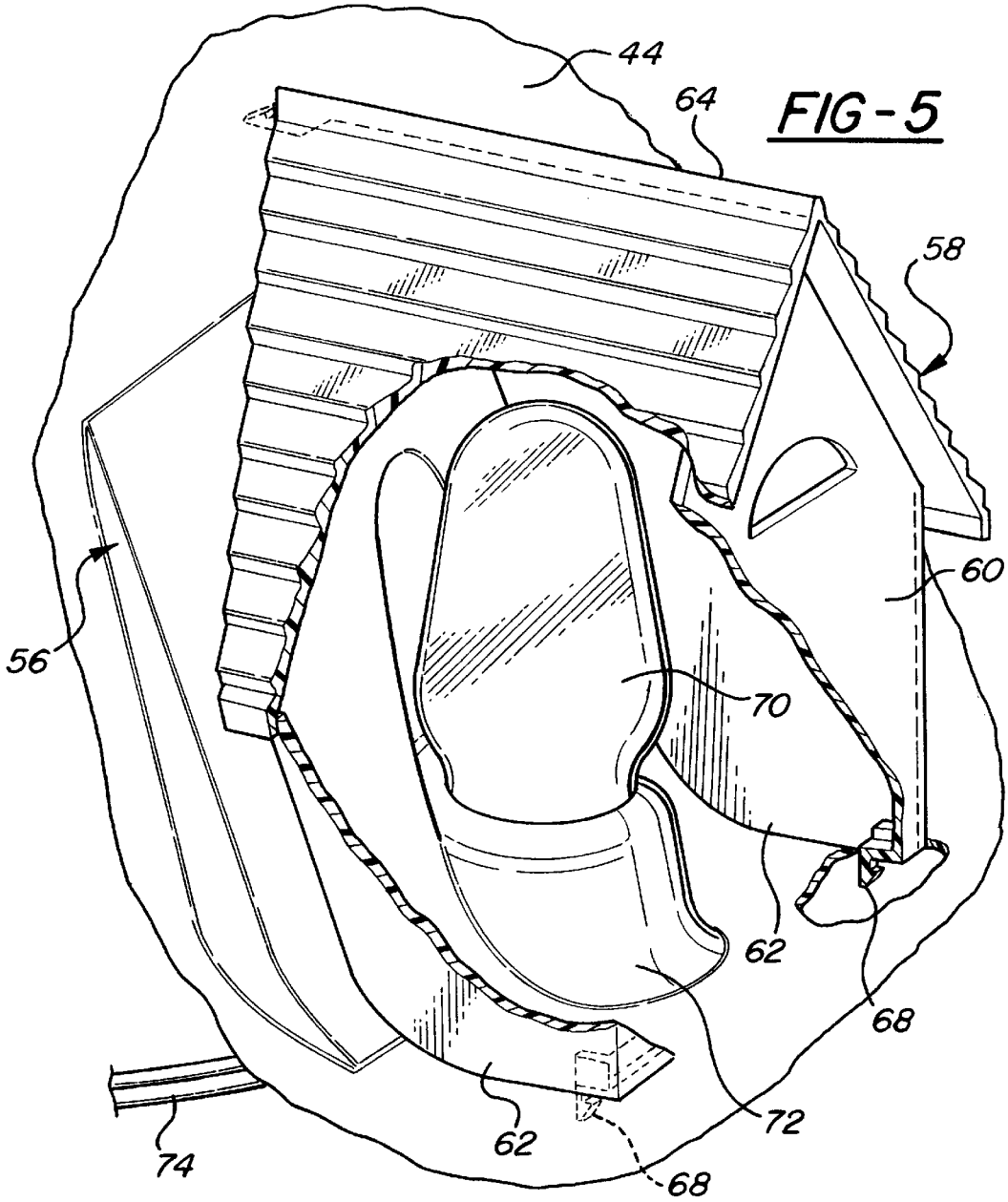
FIG. 5 is a fragmentary perspective view showing a model structure in partial cross-section and a light bulb extending through a hole in the decorative shell.
Figure 8:
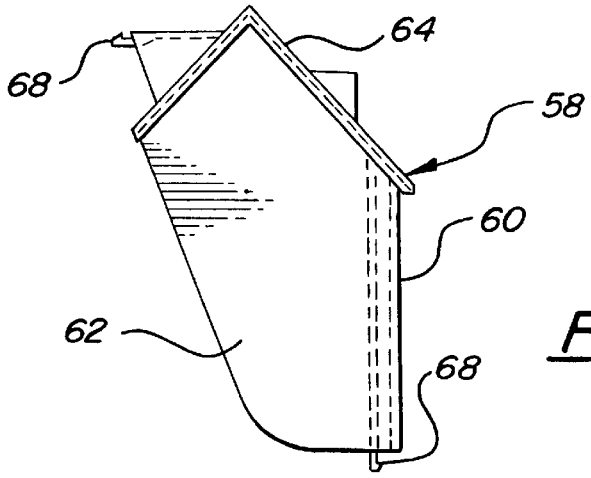
FIG. 8 is a side elevation view of the model structure of FIGS. 6 and 7 showing the hinged side walls folded to the use position.
Figure 6:
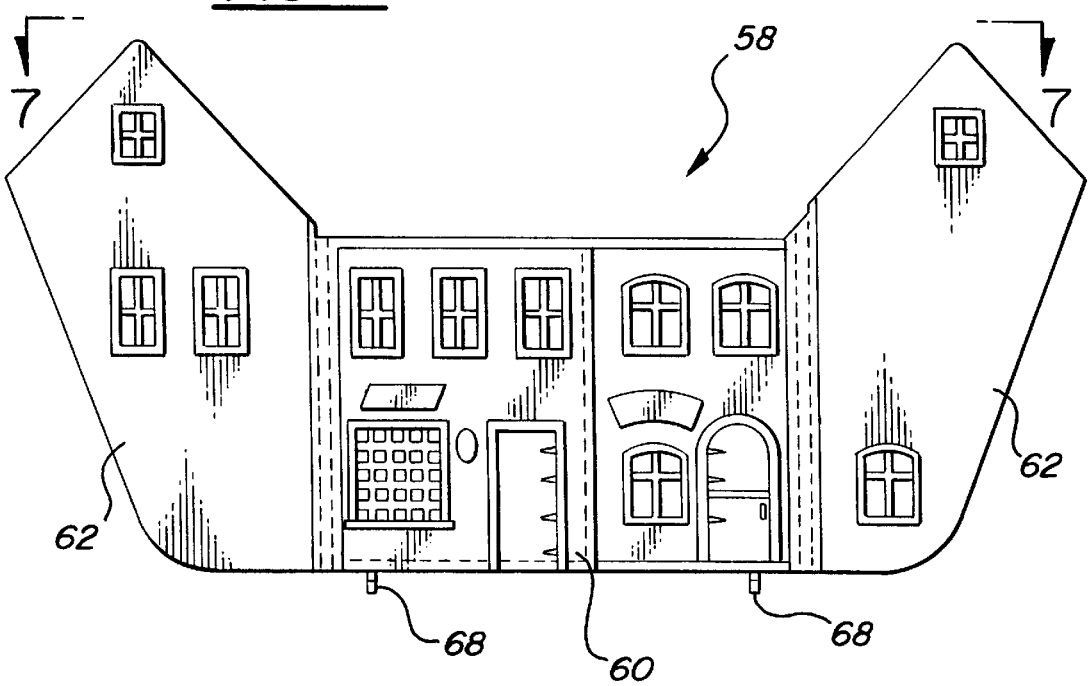
FIG. 6 is a front elevation view of the front and side walls of a model structure in a flat shipping condition.

As best shown in FIGS. 5–8, each model structure 58 has a front wall 60, a pair of side walls 62 hingedly connected to the front wall 60, and a roof 64. The front 60 and side 62 walls are injection molded as a unit, whereas the roof 64 is fabricated independently. Exterior details, such as doors, windows, signs, etc., may be integrated into the front 60 and side 62 walls to facilitate painting. These details may be both surface effects, such as trim features and signs, as well as through openings representing doors and windows. The model structure 58 shown in FIG. 6 is intended to represent two side-by-side retail stores or shops, as would be found in a historic mountain setting. In FIG. 5, the model structure 58 is intended to represent a historic single family dwelling. Shingles or like details and simulations may be molded into the roof 64.

Figure 7:
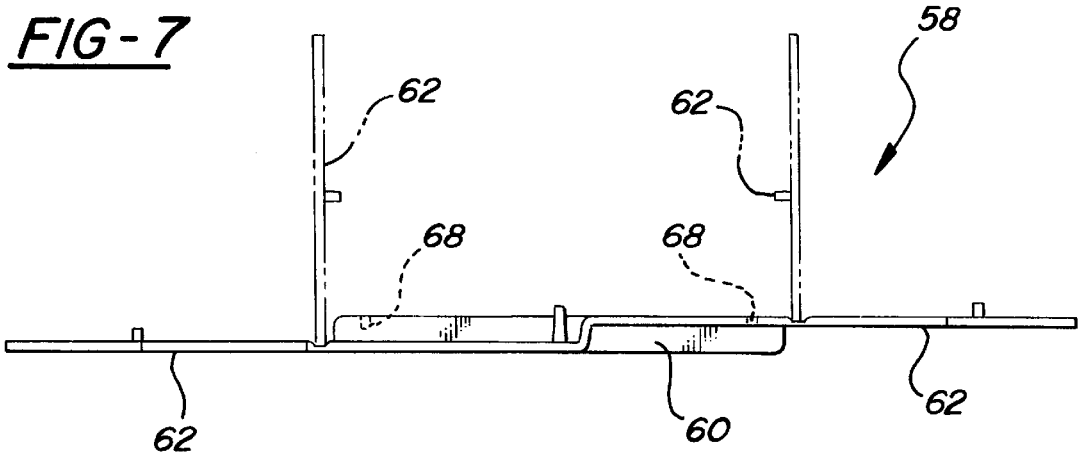
FIG. 7 is a top view as taken along lines 7—7 of FIG. 6 and showing the hinged side walls folded to a use position in phantom.

The integral front 60 and side 62 walls are molded flat for shipping and storage, and then the side walls 62 are pivoted along a living hinge region, perpendicular to the front wall 60 as shown in phantom in FIG. 7, at the time of assembly to the first section 28. Preferably, the roof 64 merely rests upon the front 60 and side 62 walls in the assembled condition, however clips or other fasteners can be used to retain the members more securely together. The roof 64 is preferably in a gambrel shape, and may be peaked in either direction.

Each receiving area 56 includes a plurality of female receivers 66 arranged in a predetermined pattern about its periphery. Likewise, each model structure 58 has a corresponding plurality of male locking cleats 68 engagable with the plurality of female receivers 66 of any one of the plurality of receiving areas 56. Preferably, the roof 64 includes one such locking cleat 68 and the bottom edge of the front wall 60 includes two locking cleats 68. Lip details on the roof 64 restrain the side walls 62 perpendicular to the front walls 60. When folded into the assembled condition, the locking cleats 68 align perfectly with the female receivers 66 to hold the model structure 58 in position on the first section 28.

Figure 9:
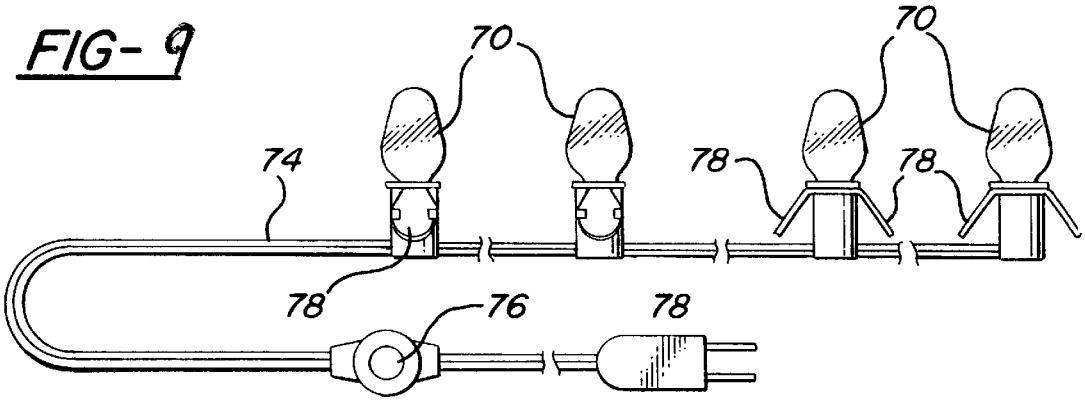
FIG. 9 is a schematic view of the light bulb string.

To further enhance the aesthetic presentation of the model structures 58, an illuminator, such as a light bulb 70, may be located so as to project light though the windows, doorways and other openings formed in the front 60 and side 62 walls of the model structures 58. A single light bulb 70 may be used to project light to all of the model structures 58, however in the preferred embodiment there is a light bulb 70 associated with each model structure 58, each extending through a hole in a boss 72 of the respective receiving area 56. An electrical cord 74 connecting the several light bulbs 70 is concealed within the hollow interior of the shell assembly 20. As shown in FIGS. 2 and 9, the electrical cord 74 may be fitted with a foot switch 76. The light bulb 70 may include manually operable spring-like attachment clips 78 for engaging the side edges of the hole in the boss 72.

In the event a decorator desires not to use one of the receiving areas 56 for presentation of a model structure 58 and is concerned aesthetically about the visibility of the hole in the boss 72 of that unused receiving area 56, a plug 80 can be removed from the skirt 44 and used to fill the exposed hole in the boss 72. It is expected that the plug 80 will be scavenged from whichever of the first 28 and second 30 sections is least visible, e.g., whichever one is against a wall or facing a corner. The outer surface of the plug 80 may be textured to match the surrounding skirt 44 surface.

Referring again to FIG. 3, the shell assembly 20 is shown including a releasable fastener arrangement for releasably connecting the left 36 and right 38 side edges of the first section 28 to the respective right 38 and left 36 side edges of the second section 30 to restrain the first 28 and second 30 sections in the opposing operational relationship enshrouding the display stand 22 while substantially fully exposing the Christmas tree 24 or other upstanding element. The releasable fasteners are particularly advantageous in allowing the decorative shell 20 to be conveniently installed over a fully erected display stand 22. That is, the display stand 22 can first be assembled together with the Christmas tree 24, to ensure it is in a proper vertical orientation, permit unrestricted access to the screws 26 or other fastening means, fill the receptacle with water, add plant food, etc., with the decorative shell 20 positioned as shown in FIGS. 1 and 2 subsequently. The releasable fasteners likewise allow the decorative shell 20 to be easily removed from around an erected display stand 22 in the event the Christmas tree 24 or merchandise display pole requires readjustment or other attention. Furthermore, the releasable fasteners are advantageous in allowing the entire decorative shell 20 to be segmented into the first 28 and second 30 sections, which nest together as a compact unit in a disassembled condition facilitating commercial display on narrow store shelves and also making storage during off season/non-use periods more convenient.

Those skilled in the art will readily appreciate that the releasable fastener may take any one of numerous alternative forms, however in the preferred embodiment comprises a plurality of male elements 82 and a corresponding plurality of female elements 84 interlocking with the male elements 82. The male elements 82 extend from the left side edge 36 of each of the first 28 and second 30 sections, whereas the female elements 84 are disposed in the right side edge 38 of each of the first 28 and second 30 sections. The male elements 82 are generally T-shaped having a shank and a perpendicular head. The female elements 84 comprise a slot having a width greater than the shank and smaller than the head of the male elements 82 so that the heads of the male elements 82 become trapped behind the female slots 84.

In the assembly process, the first section 28 and second section 30 are brought into opposing relationship, and one section is cocked slightly relative to the other so that the male 82 and female 84 elements can be moved into registry. With the male 82 and female 84 elements interlocked, the first 28 and second 30 sections are likewise interlocked and securely retained in their opposing operational relationship. The first 28 and second 30 sections are disassembled in the reverse order for storage.

Figure 10:
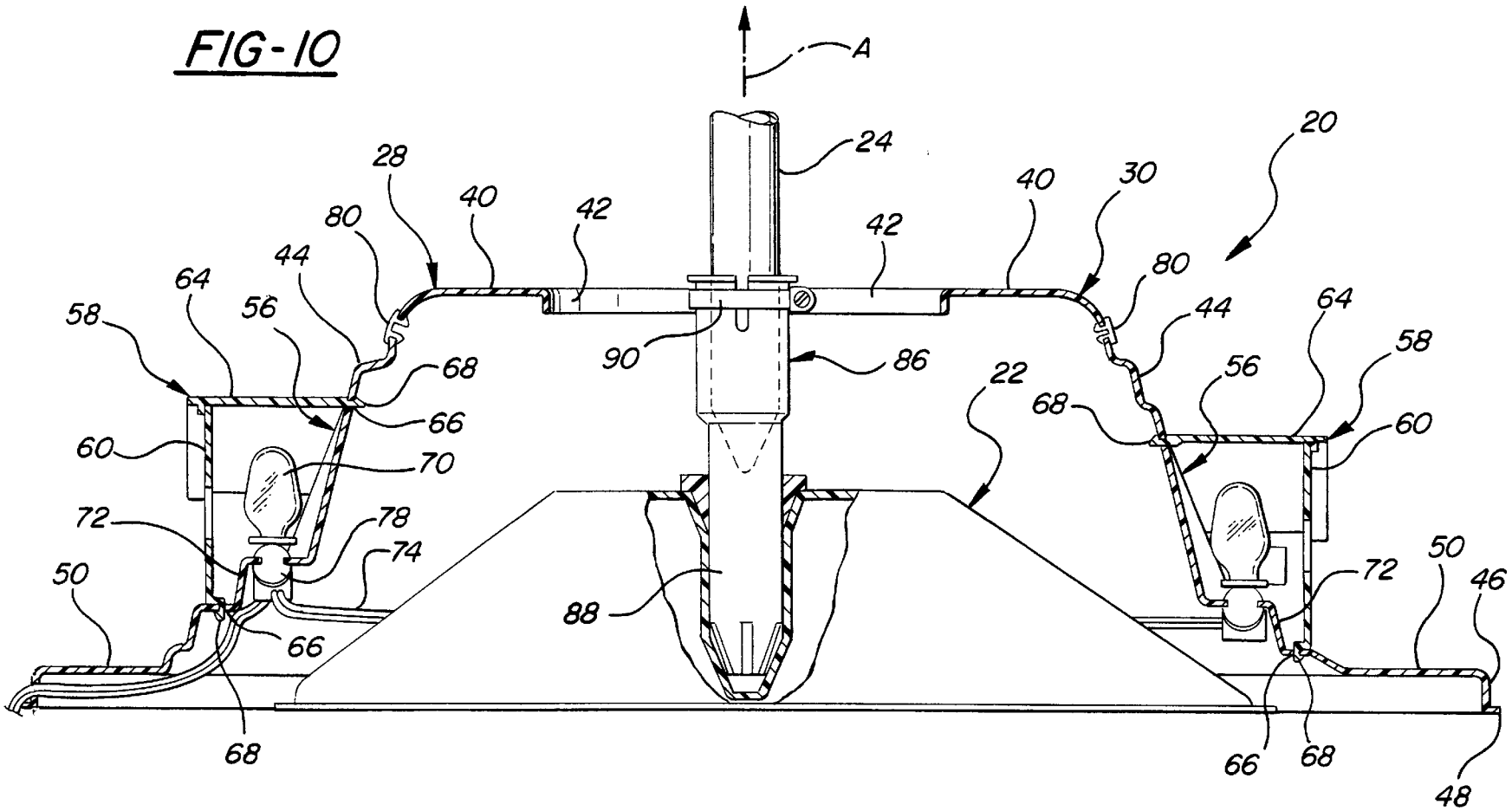
FIG. 10 is a cross-sectional view as in FIG. 2 but showing an alternative extension cup disposed in the display stand to elevate the Christmas tree.

In some applications, it may be desirable to elevate the Christmas tree 24 above that normally provided by the stand 22 to increase visibility of the decorative shell 20. In these instances, most notably occurring with artificial Christmas trees 24, an extension cup, generally indicated at 86 in FIG. 10, is disposed between the display stand 22 and the Christmas tree 24. The extension cup 86 is a generally tubular member having a necked region 88 which is diametrically sized about its exterior to correspond with the trunk of the artificial Christmas tree 24. The lower end of the necked region 88 is preferably crimped or otherwise formed into a conical shape. The upper region of the extension cup 86 is diametrically sized about its interior to correspond with the trunk of the artificial Christmas tree 24. The top edge of the extension cup 86 may include slits and an upper clamp 90 for constricting about the tree trunk to hold it securely in place.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A decorative assembly for surrounding a display stand (22) for a tree comprising;

a circular rigid shell (20) having a concave interior and convex exterior;

said shell (20) having an upper neck portion (42) defining an opening and a skirt portion (44) depending from said upper neck portion (42) to simulate a hill side;

said assembly characterized by including at least one model structure (58) attachable to said skirt portion (44).

2. An assembly as set forth in claim 1 further including at least one receiving area (56) for receiving and locating said model structure (58) along said skirt portion (44).

3. An assembly as set forth in claim 2 including a flat model structure (58) foldable along hinge lines to simulate a building.

4. An assembly as set forth in claim 3 wherein said model structure (58) has a front wall (60), a pair of side walls (62) hingedly connected to said front wall (60) along said hinge lines.

5. An assembly as set forth in claim 4 wherein the edges of said side walls (62) and said receiving area (56) are complimentary in shape whereby there is no gap between said edges of said side walls (62) and said receiving area (56).

6. An assembly as set forth in claim 4 including a roof (64) for disposition on said front wall (60) and said side walls (62).

7. An assembly as set forth in claim 6 wherein said model structure (58) and said receiving area (56) include connectors for connecting said model structure (58) to said receiving area (56).

8. An assembly as set forth in claim 6 wherein each of said receiving areas (56) includes bulb support means for supporting a light bulb assembly (70) within the associated model structure (58).

9. An assembly as set forth in claim 6 wherein each of said receiving areas (56) defines a hole for supporting a light bulb assembly (70) within the associated model structure (58).

10. An assembly as set forth in claim 9 including a light bulb assembly (70) disposed in said hole in said boss (72).

11. An assembly as set forth in claim 10 wherein said light bulb assembly (70) includes an attachment clip (78) attaching said light bulb assembly (70) to said boss (72).

12. An assembly as set forth in claim 11 wherein each of said receiving areas (56) includes a boss (72) and said hole is disposed in said boss (72), said boss (72) being positioned to hold a light bulb assembly (70) upright within the associated model structure (58).

13. An assembly as set forth in claim 6 wherein said receiving area (56) includes a plurality of female receivers (66) arranged in a predetermined pattern.

14. An assembly as set forth in claim 13 wherein said model structure (58) includes a plurality of male locking cleats (68) in said predetermined pattern for engaging said female receivers (66).

15. An assembly as set forth in claim 14 including a plurality of said receiving areas (56) and a plurality of said model structures (58), all of said receiving areas (56) and said model structures (58) having the same predetermined pattern for interchangeableness.

16. An assembly as set forth in claim 15 wherein said model structures (58) present different types of buildings.

17. An assembly as set forth in claim 16 wherein said shell (20) includes a shelf (50) extending annularly around said skirt portion (44) to form a continuous pathway.

18. An assembly as set forth in claim 15 including a model railroad track (52) disposed on said shelf (50).

* * * * *